US007726656B1

(12) United States Patent
Kuchcinski et al.

(10) Patent No.: US 7,726,656 B1
(45) Date of Patent: Jun. 1, 2010

(54) PORTABLE HORSESHOE PITCHING STATION

(76) Inventors: Daniel P Kuchcinski, 7550 Buckingham Pl., Fairview, PA (US) 16415; Dale R Pierce, 7423 W. Ridge Rd., Fairview, PA (US) 16415; Robert M. Sok, 6338 Meadowrue La., Erie, PA (US) 16505

( * ) Notice: Subject to any disclaimer, the term of this patent is extended or adjusted under 35 U.S.C. 154(b) by 99 days.

(21) Appl. No.: 12/228,107

(22) Filed: Aug. 8, 2008

(51) Int. Cl.
*A63B 67/06* (2006.01)

(52) U.S. Cl. ..... 273/336

(58) Field of Classification Search ..... 273/336, 273/338, 348, 317
See application file for complete search history.

(56) References Cited

U.S. PATENT DOCUMENTS 3,844,560 A * 10/1974 Litsch ..... 273/336
4,273,340 A * 6/1981 Hackett ..... 273/336
4,314,702 A * 2/1982 Updike et al. ..... 273/336
4,952,073 A * 8/1990 Wieland ..... 383/4
4,964,644 A * 10/1990 Hull et al. ..... 273/336
5,324,042 A * 6/1994 Demas ..... 273/348.4
2008/0029963 A1* 2/2008 Cornfield ..... 273/336

* cited by examiner

*Primary Examiner*—Raleigh W. Chiu
(74) *Attorney, Agent, or Firm*—Richard K Thomson

(57) ABSTRACT

A multi-section board is sandwiched by a fabric base and a fabric pillow-top, with the two fabric layers being stitched together along the edges and along the seams between the board sections. Pockets in the pillow-top receive fill which can be manmade or natural to form a cushion for the pitched elastomeric pitching shoes which are used with the pitching station. The stake is attached to a plate that is received in a pocket in the two fabrics. The stake and plate may be steel or plastic. The pitching station can be formed into a convenient triangular shape for storage and transport.

13 Claims, 3 Drawing Sheets

PORTABLE HORSESHOE PITCHING STATION

BACKGROUND AND SUMMARY OF THE INVENTION

The present invention is directed to the sports field. More particularly, the present invention is directed to a portable horseshoe pitching station suitable for both indoor and outdoor use when employing rubber pitching shoes.

Pitching horseshoes is becoming an increasingly popular pastime. However, the conventional layout requiring a permanent pit and conventional metal shoes is a deterrent to use in certain environments. These environments include school playgrounds, correctional institutions, indoor locations including gymnasiums, and the like.

It is among the objects of the present invention to remove this deterrent by providing a portable pitching station which may be used indoors or outdoors with elastomeric pitching shoes. Applicants have already filed U.S. patent application Ser. No. 11/906,847 on Oct. 3, 2007 directed to the elastomeric shoes which is hereby incorporated by reference. The portable pitching station of the present invention comprises apparatus for both outdoor and indoor use in conjunction with elastomeric pitching shoes, the portable horseshoe pitching station comprising a) a rectangular ground-engaging fabric base; b) a fabric cushion or pillow-top attached to the fabric base forming a plurality of pillow pockets; c) a multi-section board sandwiched between the rectangular ground-engaging fabric base and said fabric pillow-top; d) a fill material inserted into at least one of said plurality of pillow pockets; e) a plate secured between said fabric base and said fabric pillow-top; f) a stake affixed to said plate and protruding through said fabric pillow-top. The fabric base is made of a material selected from a group consisting of coated fabric and uncoated woven fabric. The fabric pillow-top is also made of a coated woven fabric or an uncoated woven fabric. The multi-section board is preferably made of a plastic material and, most preferably from high density polyethylene.

The fill material is selected from a group consisting of virgin thermoplastic polymer pellets, virgin thermoset polymer pellets, recycled thermoplastic polymer pellets, recycled thermoset polymer pellets, granulated natural rubber, granulated synthetic rubber, dried agricultural products, granulated clay, sand, crushed stone, sawdust, wood chips, shavings, wood pellets, natural fibers, and artificial fibers. When plastic materials are used, they may be selected from a list of amorphous or semi-crystalline materials including polyethylene (PE), polypropylene (PP), polyamide (PA), polyamide-Imide, polyarylates, polybutylene, polybutylene terephthalate (PBT), polyethylene terephthalate (PET), polycarbonate (PC), acrylonitrile-butadiene-styrene (ABS), styrene acrylonitrile, styrene butadiene, other styrene copolymers, polyketones, polyphenylene oxide, polyphenylene sulfide, polystyrene, acetal polyurethanes, polyvinyl chloride (PVC), polyvinyl acetate, other vinyls, sulfone polymers, saturated thermoplastic polyesters, unsaturated thermoplastic polyesters, melamine-formaldehyde, urea-formaldehyde, nitrile resins, and phenolics.

Preferably seams are formed between the plurality of pillow pockets at junctures of the multi-section boards, the seams facilitating folding of the portable horseshoe pitching station into a transportable, stored configuration. Also included are a) a first handle secured to a first forward edge of the rectangular fabric base b) a second handle secured to a second rear edge of the rectangular fabric base; c) a hook-and-loop fabric fastener securing the first handle to the second handle when the portable pitching station is folded into its transportable, stored configuration. More preferably, the first and second handles comprise the terminal ends of a continuous loop of webbing material stitched to the fabric base. Hook-and-loop strips and a grommet secure the pillow-top to the base.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
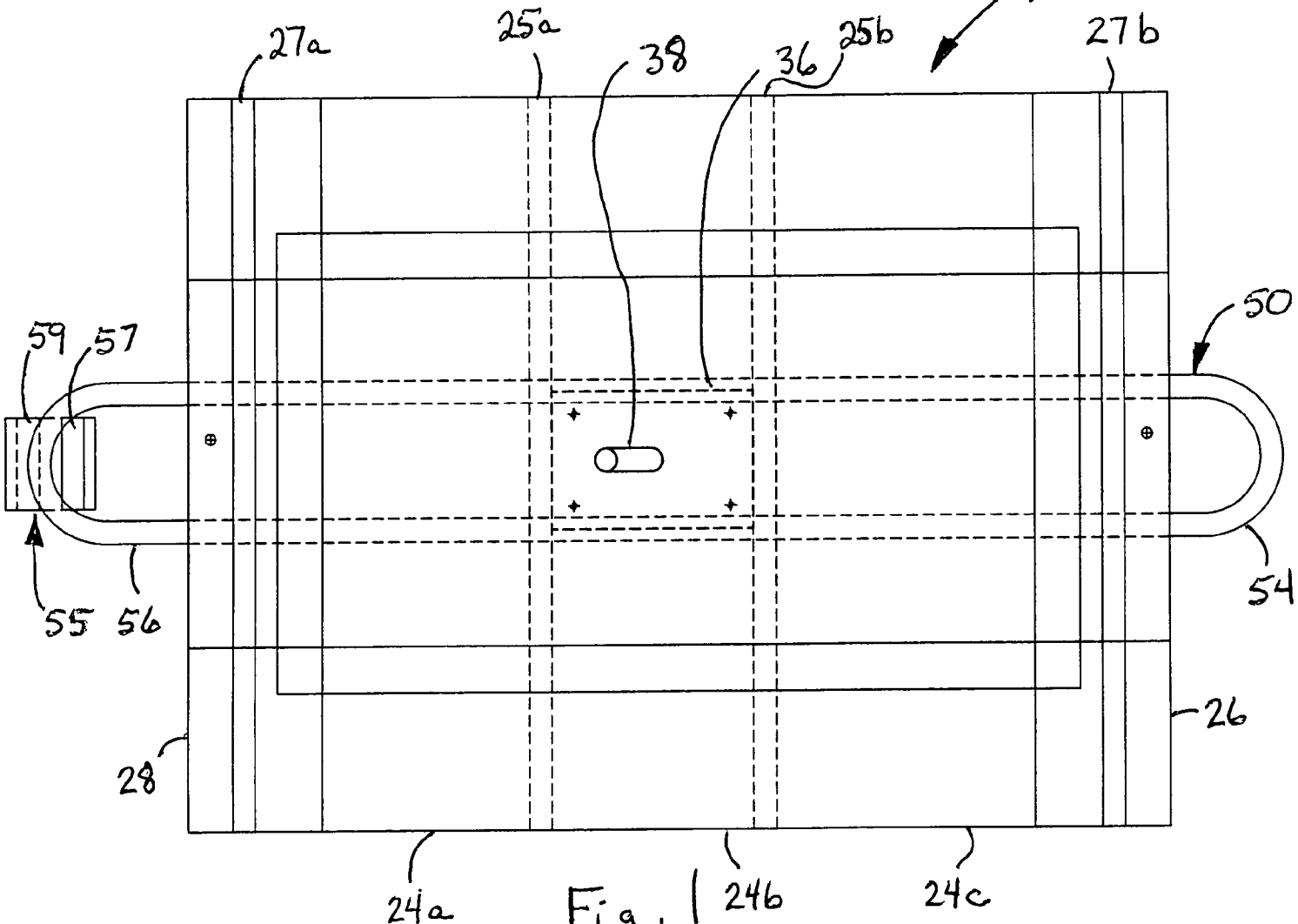
FIG. 1 is a top perspective view of a first embodiment of the portable horseshoe pitching station of the present invention with the pillow-top removed.
Figure 2:
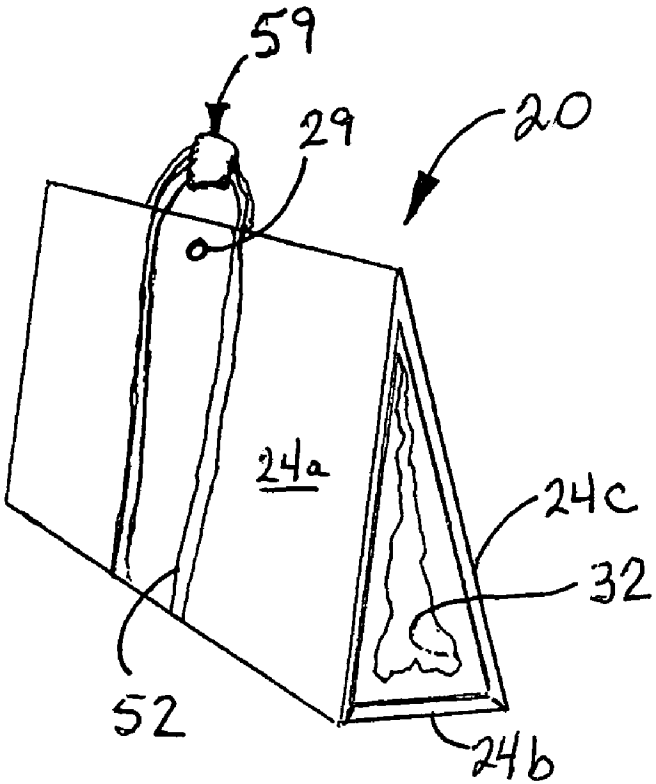
FIG. 2 is a front perspective view of the first embodiment in stored configuration.

A first embodiment of the portable horseshoe pitching station is shown in FIGS. 1 and 2 generally at 20. A rectangular ground-engaging fabric base 22*a* (FIG. 3) and a second top fabric layer 22*b* are bonded to board 24. The fabric base 22*a* and companion layer 22*b* may be a coated or uncoated woven fabric of natural or synthetic fibers. Coated fabric may be used to improve treatability for cleaning and reduce bacterial growth. The multi-section board 24 is preferably a plastic and most preferably, a high density polyethylene (HDPE). As depicted in FIG. 1, multi-section board 24 is comprised of three sections 24*a*, 24*b*, 24*c*, with a fabric base 22*a* and top fabric layer 22*b* sandwiching them and being sewn together, having seams adjacent the edges of the boards to form spaces 25*a*, 25*b* between each pair of the three sections. A pocket secures plate 36 and stake 38 affixed thereto in place between fabric base 22*a* and top layer 22*b*. The size of spaces 25*a*, 25*b* between boards 24*a*, 24*b* and between 24*b*, 24*c* is adequate to permit folding into a transportable, storage configuration (FIG. 2). Aligned holes 29 (one shown) through boards 24*a*, 24*c* permit a lock to be placed on the pitching station 20 to permit unauthorized tampering with the station or its contents. Currently, plate 36 and stake 38 are made of rolled steel. However, it is envisioned that a suitable plastic plate and stake embodiment could be developed, as well. It will be recalled that the pitching station 20 of the present invention is only intended for use with elastomeric horseshoes and, therefore, stake 38 does not have to withstand the rigors of metal shoes clanking off of it.

Figure 5:
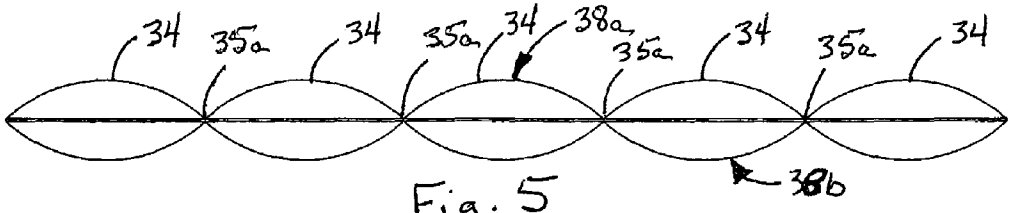
FIG. 5 is an end view of the pillow-top.
Figure 4:
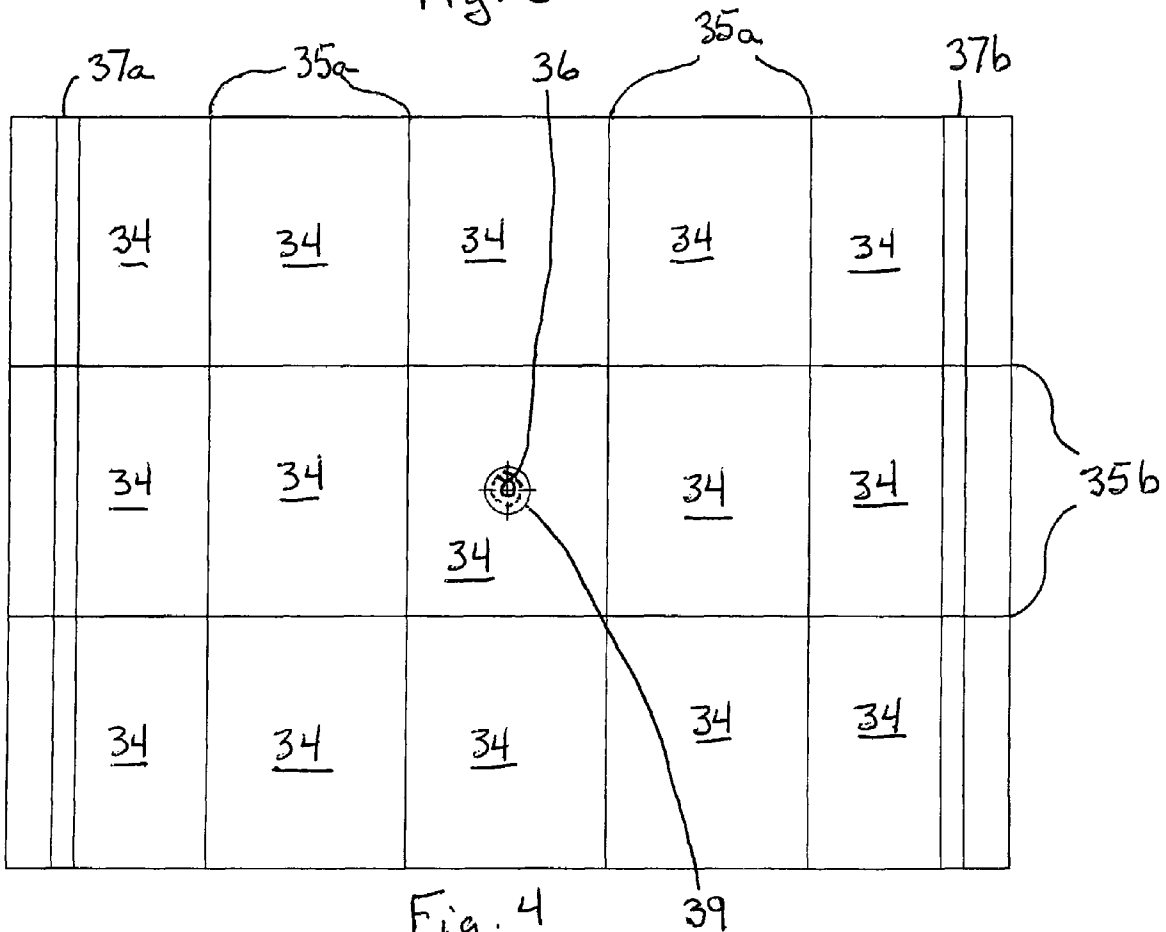
FIG. 4 is a bottom view of the pillow-top.

A fabric cushion or pillow-top 32 (FIG. 4) is secured to fabric base 22 by hook-and-loop strips 27*a*, 27*b* (FIG. 1) on top fabric layer 22*b* that are engaged by hook-and-loop strips 37*a*, 37*b* on the bottom of pillow-top 32. Stitching 35*a* across and 35*b* longitudinally along pillow-top 32 form a plurality of pockets 34 (FIG. 4). A hole 36 (FIG. 4) formed through the lower (38*a*) and upper (38*b*) layers of pillow-top 32 (FIG. 5) receives a grommet 39 which slips snugly over stake 38 to hold the center of pillow-top 32 in place.

Figure 3:
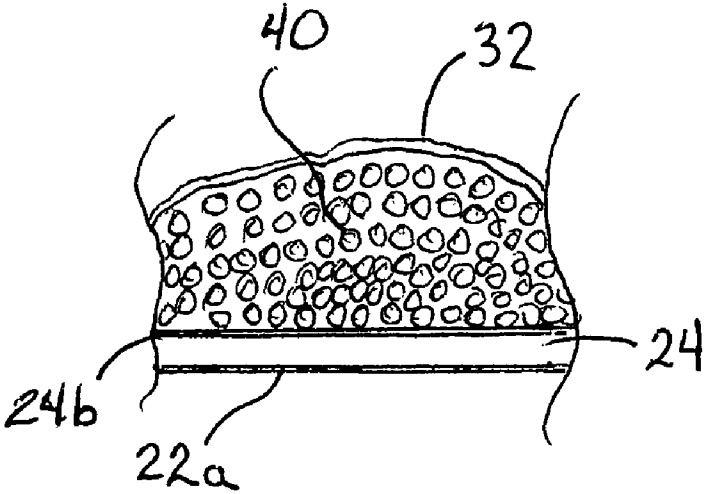
FIG. 3 is a cross-sectional view through one of the pillow pockets of the first embodiment.

As best seen in FIG. 3, each of these pockets 34 contains a fill material 40. Fill material 40 may be natural or manmade. Suitable manmade materials include pellets or granules of virgin or recycled thermoplastic or thermoset polymers. Polymers which produce a satisfactory fill include polyethylene (PE), polypropylene (PP), polyamide (PA), polyamide-Imide, polyarylates, polybutylene, polybutylene terephthalate (PBT), polyethylene terephthalate (PET), polycarbonate (PC), acrylonitrile-butadiene-styrene (ABS), styrene acrylonitrile, styrene butadiene, other styrene copolymers, polyketones, polyphenylene oxide, polyphenylene sulfide, polystyrene, acetal polyurethanes, polyvinyl chloride (PVC), polyvinyl acetate, other vinyls, sulfone polymers, saturated thermoplastic polyesters, unsaturated thermoplastic polyesters, melamine-formaldehyde, urea-formaldehyde, nitrile resins, and phenolics. Natural materials providing suitable fill include dried agricultural products, granulated clay, sand, crushed stone, sawdust, wood chips, shavings, wood pellets, natural fibers, and artificial fibers. Lastly, granulated rubber, both natural and synthetic, may be utilized as fill.

Handle assembly 50 is constructed as a single continuous loop 52 of webbing. Loop 52 is stitched to an exterior portion of fabric base 22 so that first handle 54 is secured to and extends beyond first front edge 26 of fabric base 22 and second handle 56 is secured to and extends beyond second rear edge 28 of fabric base 22. A fabric fastener 55 has a first hook-and-loop fabric strip 57 on a first side and a second hook-and-loop fabric strip 59 on the opposite side such that fabric fastener 55 may be wrapped around first and (54) second (56) handles to maintain them together when the portable horseshoe pitching station 20 is in its transportable storage configuration (FIG. 2).

Portable horseshoe pitching station 20 can be easily folded into a convenient triangular shape for storage and/or transport (FIG. 2) with the elastomeric horseshoes (not shown) secured inside. The fabric fastener 55 is wrapped around both handles 54, 56 and the two hook-and-loop fabric strips 57, 59 engaged to secure station 20 in its portable, storage configuration.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

We claim:

1. A portable horseshoe pitching station for both outdoor and indoor use in conjunction with elastomeric pitching shoes, said portable horseshoe pitching station comprising a) a rectangular ground-engaging fabric base;

b) a fabric pillow-top attached to said fabric base forming a plurality of pillow pockets;

c) a multi-section board sandwiched between said rectangular ground-engaging fabric base and a second top fabric layer;

d) a fill material inserted into at least one of said plurality of pillow pockets;

e) a plate secured between said fabric base and said top fabric layer;

f) a stake affixed to said plate and protruding through said fabric pillow-top.

2. The portable horseshoe pitching station of claim 1 wherein said fabric base and said second top fabric layer are made of a material selected from a group consisting of coated woven fabric and uncoated woven fabric.

3. The portable horseshoe pitching station of claim 2 wherein said fabric pillow-top is made of a material selected from a group consisting of coated woven fabric and uncoated woven fabric.

4. The portable horseshoe pitching station of claim 3 wherein said multi-section board is made of a plastic material.

5. The portable horseshoe pitching station of claim 4 wherein said multi-section board is most preferably made of high density polyethylene.

6. The portable horseshoe pitching station of claim 5 wherein said fill material is selected from a group consisting of virgin thermoplastic polymer pellets, virgin thermoset polymer pellets, recycled thermoplastic polymer pellets, recycled thermoset polymer pellets, granulated natural rubber, granulated synthetic rubber, dried agricultural products, granulated clay, sand, crushed stone, sawdust, wood chips, shavings, wood pellets, natural fibers, and artificial fibers.

7. The portable horseshoe pitching station of claim 6 wherein a list of materials suitable for producing said virgin and recycled thermoplastic and thermoset pellets include polyethylene (PE), polypropylene (PP), polyamide (PA), polyamide-Imide, polyarylates, polybutylene, polybutylene terephthalate (PBT), polyethylene terephthalate (PET), polycarbonate (PC), acrylonitrile-butadiene-styrene (ABS), styrene acrylonitrile, styrene butadiene, other styrene copolymers, polyketones, polyphenylene oxide, polyphenylene sulfide, polystyrene, acetal polyurethanes, polyvinyl chloride (PVC), polyvinyl acetate, other vinyls, sulfone polymers, saturated thermoplastic polyesters, unsaturated thermoplastic polyesters, melamine-formaldehyde, urea-formaldehyde, nitrile resins, and phenolics.

8. The portable horseshoe pitching station of claim 1 wherein seams are formed between said plurality of pillow pockets at junctures of said multi-section boards, said seams facilitating folding of said portable horseshoe pitching station into a transportable, stored configuration.

9. The portable horseshoe pitching station of claim 8 further comprising a) a first handle secured to a first forward edge of said rectangular fabric base;

b) a second handle secured to a second rear edge of said rectangular fabric base;

c) a hook-and-loop fabric fastener securing said first handle to said second handle when said portable pitching station is folded into said transportable, stored configuration.

10. The portable horseshoe pitching station of claim 9 wherein said first and said second handle comprise the terminal ends of a continuous loop of webbing material stitched to said fabric base.

11. The portable horseshoe pitching station of claim 1 further comprising attachment means to secure said fabric pillow-top to said second top fabric layer.

12. The portable horseshoe pitching station of claim 11 wherein said attachment means comprises hook-and-loop fabric strips securing first and second ends of said pillow-top to said second top fabric layer.

13. The portable horseshoe pitching station of claim 12 further comprising an elastomeric grommet which fits in a central hole in said pillow-top said grommet having a through bore which fits snugly on said stake.

* * * * *